United States Patent [19]

Winn et al.

[11] 4,395,080

[45] Jul. 26, 1983

[54] CONSTRUCTION SET FOR THE MANUFACTURE OF FRAMES FOR FURNITURE

[75] Inventors: Klaus Winn, Giessen; Klaus-Ludwig Engelbach, Dillenburg; Leo Schnirch, Haiger, all of Fed. Rep. of Germany

[73] Assignee: Weyel KG Visuelle Einrichtungen, Haiger, Fed. Rep. of Germany

[21] Appl. No.: 229,387

[22] Filed: Jan. 28, 1981

[30] Foreign Application Priority Data

Jan. 31, 1980 [DE] Fed. Rep. of Germany ..... 3003367

[51] Int. Cl.[3] ..... A47B 47/00; F16B 12/00

[52] U.S. Cl. ..... 312/257 R; 312/257 SK; 312/140; 312/111; 403/309; 52/656; 52/732

[58] Field of Search ..... 312/257 SK, 257 R, 257 A, 312/140, 111; 52/468, 469, 656, 461, 732; 403/309

[56] References Cited

U.S. PATENT DOCUMENTS

| | | | |
|---|---|---|---|
| 1,605,597 | 11/1926 | Long | 312/140 |
| 3,381,436 | 5/1968 | Elliott et al. | 52/468 |
| 3,528,692 | 9/1970 | DeVries | 403/295 |
| 3,675,594 | 7/1972 | Kritske | 312/111 |
| 3,779,177 | 12/1973 | Gigante | 312/257 A |
| 3,820,299 | 6/1974 | Verholt | 312/257 R |
| 3,841,725 | 10/1974 | Dorner | 312/111 |
| 3,841,726 | 10/1974 | Andros et al. | 312/111 |
| 4,082,324 | 4/1978 | Obrecht | 403/309 |
| 4,226,488 | 10/1980 | Vincent | 312/111 |

FOREIGN PATENT DOCUMENTS

| | | | |
|---|---|---|---|
| 1087845 | 3/1955 | France | 312/140 |
| 1349531 | 4/1974 | United Kingdom | 52/468 |

*Primary Examiner*—Victor N. Sakran

*Attorney, Agent, or Firm*—Flynn, Thiel, Boutell & Tanis

[57] ABSTRACT

A construction set for the manufacture of frames for furniture, such as display cabinets, showcases and the like, having base profiles and enlargement profiles, wherein the base profiles have on their front viewing side a closed viewing surface and on their back side a profiled connecting edge. The enlargement profiles also have a profile connecting edge which can be connected to the connecting edge of the base profile. The enlargement profiles have, on both oppositely positioned longitudinal edges, respective connecting edges which are constructed mirror-inverted to one another and are also constructed the same as the connecting edges on the base profiles. The construction set also includes connecting profiles insertable between two closely opposed connecting edges such that the inserted connecting profile clamps together the adjacent base and/or enlargement profiles whose connecting edges oppose one another.

23 Claims, 7 Drawing Figures

CONSTRUCTION SET FOR THE MANUFACTURE OF FRAMES FOR FURNITURE

FIELD OF THE INVENTION

The invention relates to a construction set for the manufacture of frames for furniture, in particular for furniture like display cabinets and showcases, having base profiles and enlargement profiles, whereby the base profiles have on their front viewing side a closed viewing surface and on their back side a profiled connecting edge, while the enlargement profiles also have a profiled connecting edge, which can be connected to the connecting edge of the base profiles.

BACKGROUND OF THE INVENTION

In many building programs, furniture items are needed which are of different depth, but which are the same in their basic construction. This is for example true for showcases. Thus, besides very flat showcases, which serve for example to receive a bulletin board for papers and the like flat articles, also showcases with greater depths are needed, for example showcases for the display of three-dimensional articles of greater depth. Depending on the articles to be displayed, the desired depth differs. Showcases which are to be fastened on a wall are glazed only on one side, while showcases which are to be set up freely are as a rule glazed on both sides.

To permit economical manufacture of cases with different dimensions, it is desirous to be able to use as much as possible the same structural parts for all designs. In the case of a conventional construction set of the above-mentioned type, the enlargement profiles are connected directly to the base profiles. The profiles are connected through movement into one another in their longitudinal direction. The conventional system has very little universality, since only showcases with two different frame depths can be manufactured.

The basic purpose of the invention is to provide a construction set of the above-mentioned type so that the frames can be manufactured with more than two different depths, whereby selectively only one side of the frame, or both frame sides, are to be constructed as viewing sides.

This purpose is attained according to the invention by the enlargement profiles having, on both oppositely lying longitudinal edges thereof, connecting edges which are constructed mirror-inverted to one another and by the construction set including also connecting profiles, which can be inserted between two connecting edges which follow one another (i.e. are opposed to one another) and in the inserted condition clamp together the profiles which belong to such opposed connecting edges.

With such a construction set it is possible to manufacture both vary narrow frames, for example for flat showcases, and also frames with a multiplicity of depths, for example deep showcases which are to be glazed on both sides. The most narrow frame is obtained if only base profiles are used. The most narrow frame, which is suited for two-sided glazing, is obtained if one connects two base profiles by means of the connecting profile. A frame of equal depth is obtained, if one base profile is connected to one enlargement profile. For larger frame depths enlargement profiles are always used, therein due to the mirror-inverted construction of the connecting edges as many enlargement profiles may be inserted as are desired.

Connecting profiles which are installable transversely with respect to the profile longitudinal direction make the installation easier. However, profiles which are installed by moving in the longitudinal direction are also within the scope of the invention. With profiles which can be installed transversely, it is advantageous if these are installed from the inner side of the frame, so as to be visible only on the inner side of the frame and so as to permit the connecting edges of the adjacent base profiles and/or enlargement profiles to directly follow one another on the outside of the frame. As to connecting profiles which can be installed by longitudinal movement, it is possible to permit, both on the inside of the frame and also on the outside, the base profiles and/or enlargement profiles to follow one another directly.

An advantageous embodiment, for connection by means of a connecting profile, is one where the connecting edges of following profiles respectively have connecting legs positioned at right angles to the frame wall, which connecting legs abut one another where the base profiles and/or enlargement profiles are attached to one another, and wherein such connecting legs are gripped within a groove in the connecting profile, the connecting profile being inserted to clamp together the abutting connecting legs. By providing the connecting legs and connecting profile each with locking bars, a particularly secure hold is created between the interengaged profiles. Providing the connecting profiles with edge flanges on which edge bars are provided, to engage grooves in the connecting edges, supplies additional clamping. It is possible to transversely install the connecting profiles, in spite of the existence of locking bars, if the connecting profiles used have walls which can be bent apart resiliently, to achieve a snap fit.

The connecting profiles, base profiles and enlargement profiles are preferably fitted to one another in such a manner as to create a smooth overall frame surface, by providing the connecting profile on its inner side with a flat wall which lies in the same plane as the inner side surfaces of the profiles connected by such connecting profile. A particularly solid pressing together of the connecting legs at the connecting edges is obtained by providing the connecting profile with walls defining a groove therebetween and carrying projecting contact areas which rest laterally on the edge areas of the corresponding connecting legs of the corresponding base and/or enlargement profiles. By arranging seals between the connecting legs, it is possible to seal off the frame against fluid passage at the connecting points of profiles, which is of particular interest when the article to be manufactured, for example a showcase, is to be set up outside, exposed to the weather. To effect such seals, opposed grooves in the facing sides of the base profile and/or enlargement profile form a channel therebetween with an elastic gasket cord resiliently compressed therein.

A back wall holding profile can be provided as a supplement for the construction set. Such back wall holding profile can be used, for example, on showcases which are to be glazed only on one side. With the help of such back wall holding profiles, it is possible to quickly and reliably and sealingly secure back walls. Also, such back wall holding profiles can be provided with locking bars to insure a securely fixed installation of the back wall. A tight closure of the case on the back side is obtainable by use of sealing lips which are formed on the back wall holding profiles. The back wall holding profile can be provided with a groove into which the connecting leg of the associated connecting edge engages to provide an additional securement and an additional seal. Butting faces laterally of the groove make pressing in of the back wall holding profiles easier. Sealing lips on a gripping-over leg of the back wall holding profile provide further safety against penetration of moisture or dust.

The back wall is preferably provided with rectangular edge bends insertable into recesses in the connecting edges of the opposed enlargement or base profile, which provides for easy manufacture of the back wall as well as for easy installation thereof. Engagement of the back wall edge bends by resilient sealing lips provides additional sealing.

Threaded channels on the base profiles and enlargement profiles at their connecting edges are advantageous for manufacture of corner connections by which the frame walls are connected to each other. Connecting screws can be screwed into such threaded channels.

Grooves for the engagement of a door or other wall member are advantageously arranged on the front viewing sides of the base profiles.

The base profiles and enlargement profiles are advantageously extruded hollow profiles, through the invention is by no means limited to this feature. Also, the other profiles, namely the connecting profiles and back wall profiles, are preferably extrusions also. Aluminum is a suitable material for the connecting profiles, base profiles and enlargement profiles, while the back wall holding profiles are preferably manufactured of plastic. While the particular materials mentioned are not critical for practicing the invention, it is generally true that the base profiles and enlargement profiles advantageously are of a material having a high modulus of elasticity, so that these profiles are stiff, while the back wall holding profile, because of its additional sealing functions, is advantageously manufactured of an elastically flexible material. Relatively great stiffness is also desirable, for manufacturing reasons, in the connecting profile.

The outer surfaces of the base profiles and enlargement profiles are advantageously of equal width. This is advantageous from the standpoint of aesthetics since the outer surfaces of the frame are visually always composed of equal width strips.

BRIEF DESCRIPTION OF THE DRAWINGS

The inventive construction set will be discussed further in connection with the enclosed drawings, in which:

FIG. 1 is a front view of a showcase, the frame of which was formed of the inventive construction set, FIGS. 2 to 4 are side views of three frames of different width, FIGS. 5 to 7 are cross-sectional views along the line A-B of FIG. 1 in a scale which is much enlarged compared to FIG. 1, wherein FIG. 5 shows the cross section of a frame wall comprised of two base profiles, FIG. 6 shows the cross section of a frame wall comprised of a base profile and an enlargement profile and FIG. 7 shows a frame wall comprised of two base profiles and one enlargement profile.

DETAILED DESCRIPTION

Figures 1, 2, 3, 4, 5:
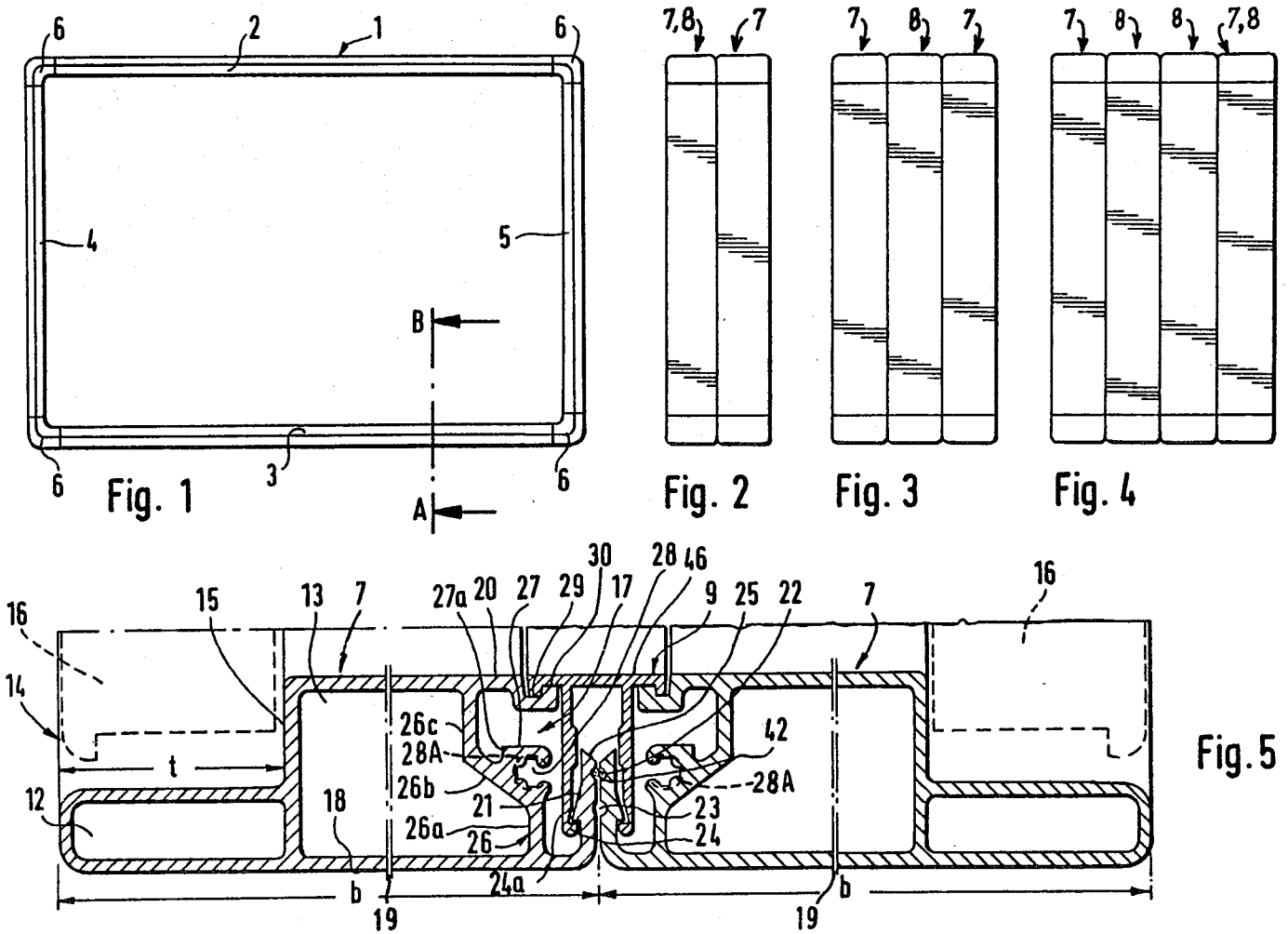

The showcase according to FIG. 1 has a frame generally indicated at 1. This frame is composed of two long frame walls 2, 3 and two short frame walls 4, 5. The frame walls are connected by corner pieces 6. The frame walls can be constructed differently and can have different depths, whereby for forming the different frames only some structural parts are necessary. These structural parts will be discussed hereinafter in connection with FIGS. 5 to 7.

Base profiles 7, enlargement profiles 8, connecting profiles 9, back wall holding profiles 10 and a back wall 11 are part of the special construction set shown in the drawings. These parts and their cooperation are described hereinafter.

Figure 6:
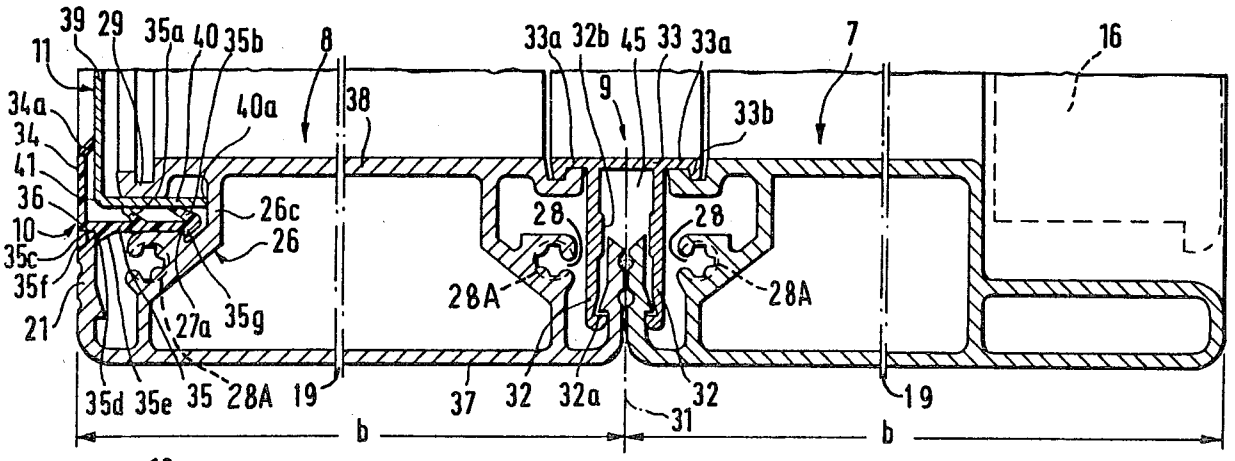
Figure 7:
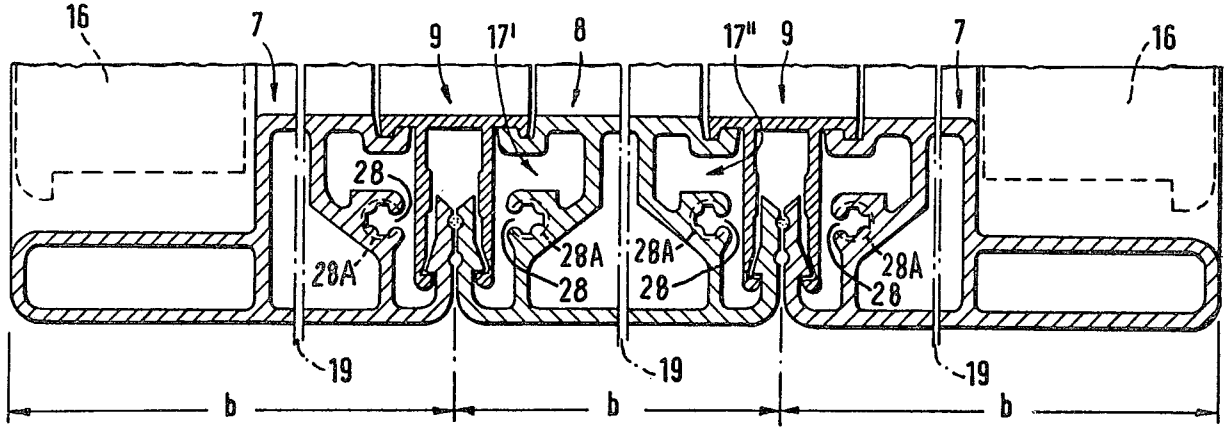

The base profiles 7 are described in connection with the example of the base profile which appears on the left in FIG. 5. The base profile comprises an extruded hollow profile with closed chambers 12 and 13. The base profiles have a front viewing side generally indicated at 14 and which is on the front side of the frame, on which a door or a glass wall is to be mounted. A groove 15 is provided on such front viewing side and has a depth t so great as to provide room therein for a door 16 (illustrated in dashed lines in FIG. 5) or a fixed wall. The base profile has a longitudinal side opposite to said front side and which is identified by reference numeral 17 and constructed as a connecting edge. The outer side surface 18 is constructed flat and has a width b. In FIGS. 5 to 7, parts are broken out of the profiles and the broken-out areas are indicated by dash-dotted lines 19. The width b may for example be 130 mm. Also the inner surface 20 of the profile is constructed flat.

A connecting leg 21 is provided on the connecting edge 17, which leg has on its outer side two longitudinal grooves 22 and 23. A locking bar 24 with an inclined butting face **24*a* is provided on the inner side. The connecting leg 21 has an inclined end face 25** on the front side.

A profile wall generally indicated at 26 extends parallel to the connecting leg 21. This profile wall has three sections **26*a*, 26*b* and 26*c*. The sections 26*a* and 26*c* are parallel to one another and extend at a right angle to the outer walls 18 and 20. The wall portion 26*b* extends at an angle of 45° thereto. A shoulder 27 is provided on the outer side of said wall, which shoulder 27 encloses an outwardly open threaded channel 28 with internal threads 28**A.

A groove 29 is provided on the edge of the wall 20, adjacent to the connecting edge 17. The end face 30 of the outer groove defining wall is slightly set back with respect to the outer surface of the wall 20.

The structure of the connecting profiles 9 will be described hereinafter in connection with FIG. 6. The connecting profiles 9 are each symmetrical with respect to their longitudinal center plane indicated by the dash-dotted line 31 in FIG. 6. On both sides of said longitudinal center plane the connecting profile has walls 32, which can be bent apart elastically. The walls 32 are connected by a web 33. The walls 32 and the web 33 form together a groove 45. The web 33 is extended beyond the walls 32 to form edge flanges **33*a*. Each of these edge flanges has an edge bar 33*b*, which is parallel to the walls 32**.

The walls 32 have locking bars **32*a* at their ends, which project inwardly with respect to the wall inner surfaces. Projecting contact surfaces 32*b* are also provided on the inner surfaces of the walls 32. The outer surface 46** of the connecting profile is flat.

The back wall holding profile 10 has a cross section of an angular basic form with legs 34 and 35. The gripping-over leg 34 has a sealing lip 34*a* at its end. Two sealing lips 35*a* and 35*b* are provided on the leg 35, which sealing lips 35*a* and 35*b* are arranged on the inner side of the wall 35 and point in direction of the leg 34.

A groove 36 defined by walls 35*c* and 35*d* is provided on the back side of the leg 35. The wall 35*d* has an inclined butting face 35*e*, while the wall 35*c* has an also inclined contact surface 35*f*. A locking bar 35*g* is formed on the edge of the leg 35.

The enlargement profiles 8 have on each of their edges a connecting edge constructed the same as the connecting edge 17 above described in connection with the example of the base profile illustrated on the left in FIG. 5. To differentiate from the connecting edges 17 on the base profiles, the connecting edges on the enlargement profiles 8 are identified by reference numerals 17' and 17''. As one can recognize from the two enlargement profiles 8 according to FIGS. 6 and 7, the connecting edges 17' and 17'' are constructed symmetrically with respect to a longitudinal center plane positioned at a right angle to the outer surfaces 37 and 38 of the enlargement profiles. The connecting edges 17' and 17'' are thus also mirror-inverted to one another. Also the enlargement profiles 8 have the width b, which is drawn in FIG. 7. It is also true for FIG. 7 that the natural widths of the profiles are shown reduced in length by breaking out parts at the dash-dotted lines 19.

The back wall 11 (FIG. 6) has a large plane surface 39 and edge walls 40 positioned at a right angle thereto and which connect through rectangular bends 41 to the flat surface 39.

The back wall 39 is manufactured generally of a metal plate, preferably a tin-plated steel plate. The base profiles 7, the enlargement profiles 8 and the connecting profiles 9 can be constructed advantageously as aluminum extrusion profiles. The back wall holding profile 10, which must be relatively flexible, preferably consists of plastic.

The profiles cooperate as follows:

It is possible to connect both base profiles to one another (FIG. 5) and also to connect base profiles to enlargement profiles (FIGS. 6, 7), and also to connect enlargement profiles to one another. The connection construction is the same in all instances, since in every connection connecting edges are positioned mirror-inverted to one another and are connected to one another through a connecting profile 9. The structure of this connection is considered hereinafter with respect to FIG. 5.

In creating the connection, the connecting legs 21 are placed on one another, whereby gasket cords 42 of an elastic material can be placed into one or both of the grooves 22, 23, which grooves supplement one another to form a channel. The connecting profile can be moved transversely to its longitudinal direction onto the abutting connecting legs 21, whereby the walls 32 are slightly spread apart, which is made easier by the butting faces 24*a*. The locking bars 32*a* engage behind the locking bars 24 on the connecting legs 21 in a fully moved-on, or locked, condition of the connecting profile. The projections 32*b* rest on the ends of the connecting bars 21 in this locked position. The edge bars 33*b* of the connecting profile engage the grooves 29.

The profiles, for example two base profiles 7, to be connected to one another are connected fixedly and sealingly with one another through this connection. The connecting profiles 9 hold the profiles to be connected at three points, namely first at the edge flange through engagement of the edge bars 33*b* in the grooves 29, second through contact of the projections 32*b* on the connecting legs, and third through engagement of the locking bars 32*a* with the locking bars 24. The connecting profiles are secured against pulling out through this latter engagement. However, demounting is still possible by pulling the connecting profiles out in their longitudinal direction.

The flat inner surfaces 20, 38 of base profiles and enlargement profiles and the flat surface 46 on the connecting profile lie in one plane, when the profiles are joined together. The end faces 30 on the profiles 7, 8 are set back by the wall thickness of the wall 33 of the connecting profile 9, in order to achieve this.

The back wall 11 is mounted after the frame is finished, namely after frame walls of a desired form and width are assembled and are connected by corner connections 6. The edge walls 40 are hereby moved in so that they rest on the outer side of the base wall of the groove 29. The edge 40*a* is supported on the section 26*c* of the profile wall 26, when the back wall is installed. The back wall holding profile 10 is subsequently installed. The locking bar 35*g* in the fully installed position engages behind a locking edge 27*a*, which is formed by the shoulder 27. At the same time the end of the connecting leg 21 engages the groove 36. To this end, the leg 34 was first (in FIG. 6) slightly pressed upwardly, which was made easier by the butting face 35*e*. The inclined end face 25 of the connecting leg and the inclined end face 35*f* of the back wall holding profile rest on one another in the fully installed position of the back wall holding profile. The sealing lips 34*a* rest resiliently on the surface 39 of the back wall, while the sealing lips 35*a* and 35*b* are pressed resiliently on the edge wall 40.

FIG. 2 illustrates the side view of frames corresponding with FIGS. 5 and 6. Since the base profiles and the enlargement profiles have both the same widths b, both frames look the same from the side. The frame according to FIG. 7 has a side view according to FIG. 3. FIG. 4 illustrates a frame, the walls of which are each composed of four wall-forming profiles 7 and 8. At least one of the outer profiles is a base profile, while the inner profiles are enlargement profiles. Each frame wall can also be composed of even more than four wall-forming profiles.

FIG. 5 illustrates the cross section of a frame wall for a showcase, which can be viewed from both sides. Thus doors 16 are arranged on both sides. In place of one of the doors it is also possible to arrange a glazed wall. FIG. 6 illustrates a showcase, which is to be viewed only from one side, for which reason a nontransparent back wall 11 is provided, while a glazed door 16 is arranged on the front side. FIG. 7 illustrates a showcase, which is to be viewed again from both sides, for which reason glazed walls are provided on both sides. Base profiles are always utilized on viewing sides, which are to be provided with glazed walls or doors, since said base profiles have a groove 15 to receive such a wall or door.

A frame wall can consist also of only one base profile. This is, for example, to be considered for showcases which contain only a display board. In this instance, the case is closed off at the rear by a back wall, while a door 16 is arranged in front.

Disclosures of showcase constructions which relate generally to the subject matter of this application may be found in two applications assigned to the same assignee as the present application, filed concurrently herewith, and respectively entitled "FRAME FOR FURNITURE, IN PARTICULAR FOR DISPLAY CABINETS AND SHOWCASES" (Ser. No. 229,236) and "CONSTRUCTION SET FOR THE MANUFACTURE OF WINDOWS, PARTICULARLY WINDOWS FOR SHOWCASES" (Ser. No. 229,388).

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A construction set for the assembly of frames for furniturelike display cabinets and show cases, comprising:

an elongated first profile means having a closed surface at one edge thereof and a first connecting edge means at another edge remote from said one edge, said first profile means having a first flat surface thereon;

an elongated second profile means having a second connecting edge along an edge adjacent said first connecting edge, said first and second connecting edges being a mirror image of the other, said second profile means having a second flat surface thereon coplanar with said first planar surface, said first and second connecting edges each including first means defining a space between said first and second profile means and separating said first and second flat surfaces and second means defining a connecting leg, said connecting legs extending parallel to each other and perpendicular to said first and second flat surfaces, said first and second profile means abutting one another along said first and second connecting edges on a side thereof remote from said space; and connecting profile means received in said space and having a pair of spaced and parallel legs straddling and engaging said first and second connecting legs, and a connecting flat wall member connected to and extending at a right angle to said first and second connecting legs, said connecting profile means functioning to hold said first and second profile means together, said connecting flat wall member having an outwardly facing surface which is coplanar with said first and second flat surfaces and closing said space between said first and second profile means.

2. A construction set according to claim 1, wherein said connecting profile means are insertable transversely with respect to the longitudinal direction of said first and second profile means.

3. A construction set according to claim 2, wherein said connecting profile means are visible only on the side having said flat surfaces, while the abutting portion of said first and second connecting edges directly follow one another on said remote side of first and second profile means.

4. A construction set according to claim 1, wherein said connecting legs each have locking bars on their inner and oppositely facing sides, which locking bars are gripped around by locking bars provided on facing sides of said legs on said connecting profile means.

5. A construction set according to claim 1, wherein said connecting profile means has edge flange means thereon received in grooves provided along the mutually adjacent edges of said first and second connecting edges.

6. A construction set according to claim 5, wherein the spacing between said connecting legs of said connecting profile means defines a groove, and wherein said connecting legs are elastic and can be flexed apart such that by transverse insertion of said connecting profile means into said space, locking bars on said connecting legs will be snapped in over said connecting edges to effect a holding of said first and second profile means together.

7. A construction set according to claim 1, wherein the spacing between said connecting legs of said connecting profile means defines a groove and said legs thereof have locking bars on the inner facing sides thereof, said inner facing sides of said groove further having arranged thereon projecting contact surfaces which rest laterally on an edge area of an associated connecting leg.

8. A construction set according to claim 1, wherein on the sides of said connecting legs facing one another there are arranged grooves which supplement one another to form a channel, said construction set also including elastic gasket cords which are compressed resiliently in said channel when said profiles are connected to one another.

9. A construction set according to claim 1, including also a back wall holding profile means insertable into said connecting edge and having a gripping-over leg for gripping over said back wall.

10. A construction set according to claim 9, wherein said back wall holding profile means has a locking bar cooperating with an undercut locking edge arranged on the corresponding connecting edge.

11. A construction set according to claim 10, wherein said back wall holding profile means has at least one resilient sealing lip, which keeps said locking bar and undercut locking edge in engagement with one another.

12. A construction set according to claim 9, wherein said back wall holding profile means has a groove into which the end of said connecting leg of the associated connecting edge engages.

13. A construction set according to claim 12, wherein laterally of said groove there is arranged a butting face for the cooperation with the edge of the connecting leg.

14. A construction set according to claim 9, wherein said gripping-over leg has at its free edge a resilient sealing lip.

15. A construction set according to claim 9, wherein said back wall has a bent right angle edge which is inserted into a recess on a said connecting edge.

16. A construction set according to claim 9, wherein said back wall holding profile means has at least one resilient sealing lip which rests on the outer side of said right angle edge.

17. A construction set according to claim 1, including internally threaded channels arranged on said first and second profile means said connecting edge thereof.

18. A construction set according to claim 1, including groove means on said first and second profile means for the engagement of a door or other wall and arranged at said closed surface.

19. A construction set according to claim 1, wherein said first and second profile means are extruded hollow profiles.

20. A construction set according to claim 9, wherein said connecting profile means and said back wall holding profile means are extrusions, said connecting profile means being of aluminum and said back wall holding profile means being of plastic.

21. A construction set according to claim 1, wherein said remote side of said first and second profile means are equally wide.

22. A construction set according to claim 1, wherein said second profile means is an enlargement profile having, in addition to said second connecting edge, a third connecting edge, said third connecting edge being identical to said first connecting edge.

23. A construction set according to claim 22, including plural first said second profile means connected edge to edge by one of said connecting profile means.

* * * * *